US008235060B2

(12) United States Patent
Konrad

(10) Patent No.: US 8,235,060 B2
(45) Date of Patent: Aug. 7, 2012

(54) METHOD AND APPARATUS FOR A MULTI-USE COSMETIC APPLICATION GUARD AND/OR STENCIL

(76) Inventor: Stefan Konrad, Baden-Baden (DE)

( * ) Notice: Subject to any disclaimer, the term of this patent is extended or adjusted under 35 U.S.C. 154(b) by 553 days.

(21) Appl. No.: 12/402,969

(22) Filed: Mar. 12, 2009

(65) Prior Publication Data

US 2010/0018542 A1 Jan. 28, 2010

Related U.S. Application Data

(60) Provisional application No. 61/083,286, filed on Jul. 24, 2008.

(51) Int. Cl.
*A45D 40/30* (2006.01)

(52) U.S. Cl. ..... 132/319; 132/200

(58) Field of Classification Search ..... 132/319, 132/216, 320, 333; 2/267, 174; 128/857, 128/849; 602/52, 57, 74
See application file for complete search history.

(56) References Cited

U.S. PATENT DOCUMENTS

| | | | | |
|---|---|---|---|---|
| D252,890 | S | 9/1979 | Cavalieri | |
| D254,935 | S | 5/1980 | Staudinger | |
| D257,400 | S | 10/1980 | Cunningham | |
| D271,530 | S | 11/1983 | Watt | |
| 4,807,650 | A * | 2/1989 | Bliss | 132/319 |
| 5,016,658 | A | 5/1991 | Green | |
| 5,050,624 | A | 9/1991 | Kobe et al. | |
| 5,052,417 | A | 10/1991 | Cordova | |
| 5,178,170 | A | 1/1993 | Kassai | |
| D341,001 | S | 11/1993 | Pantages | |
| 5,311,888 | A | 5/1994 | Leigh | |
| 5,890,499 | A | 4/1999 | Fuentes et al. | |
| 5,957,142 | A | 9/1999 | Karafilis | |
| D423,714 | S | 4/2000 | Fuentes et al. | |
| 6,199,560 | B1 | 3/2001 | North et al. | |
| 6,305,389 | B1 | 10/2001 | Bakken | |
| D467,034 | S | 12/2002 | Jaggers | |
| 6,640,814 | B1 | 11/2003 | Burke | |
| 6,807,970 | B2 | 10/2004 | Thayer | |
| D532,929 | S | 11/2006 | Weltmann | |
| D536,129 | S | 1/2007 | Davis | |
| 2005/0059918 | A1 * | 3/2005 | Sigurjonsson et al. | 602/54 |
| 2005/0244440 | A1 * | 11/2005 | Nakamura et al. | 424/401 |
| 2005/0256468 | A1 * | 11/2005 | Qin et al. | 604/358 |

FOREIGN PATENT DOCUMENTS

DE 10 2007 026 374 12/2008

* cited by examiner

*Primary Examiner* — Todd Manahan
*Assistant Examiner* — Brianne Kalach
(74) *Attorney, Agent, or Firm* — McAndrews, Held & Malloy, Ltd.

(57) ABSTRACT

A cosmetic apparatus comprising a self-adhesive cosmetic application guard and/or stencil provided, which comprise an upper edge, a lower edge, an extended flap, a front surface and a rear surface. The upper edge is shaped according to a natural curvature of a human lower eyelid. A texture of one or both of the front surface and the rear surface enables the self-adhesive cosmetic application guard and/or stencil to self-adhere to a users' skin. The extended flap enables grasping so as to avoid contact with areas of cosmetic application during removal from the users face. The front surface and the rear surface may comprise silica material, and may be glossy so that it firmly adheres to the users' skin without use of any additional adhesive product or material. The texture of one or both of the front surface and the rear surface a non-slip surface having a dull finish.

29 Claims, 13 Drawing Sheets

METHOD AND APPARATUS FOR A MULTI-USE COSMETIC APPLICATION GUARD AND/OR STENCIL

CROSS-REFERENCE TO RELATED APPLICATIONS/INCORPORATION BY REFERENCE

This application makes reference to, claims priority to, and claims the benefit from U.S. Patent Provisional Application Ser. No. 61/083,286 filed on Jul. 24, 2008.

The above stated application is hereby incorporated herein by reference in its entirety.

FIELD OF THE INVENTION

Certain embodiments of the invention relate to cosmetic applications. More specifically, certain embodiments of the invention relate to a method and apparatus for a self-adhesive cosmetic application guard and/or stencil.

BACKGROUND OF THE INVENTION

The application of cosmetics to the face can sometimes be a daunting and time consuming tasks. Great care and accuracy is often required for achieving visually pleasing results. If a user or person applying cosmetics is not careful or does not have steady hands, then visually unpleasing results may occur. For example, during the application of makeup to areas surrounding the eye including eyelashes, eyelids and eyebrows may be a time consuming task that requires a steady hand so that the makeup is not smudged or smeared in with previously applied makeup. Makeup may also drip or fall of applicators onto the user's lower eyelid or upper areas of the cheekbone.

Further limitations and disadvantages of conventional and traditional approaches will become apparent to one of skill in the art, through comparison of such appratus with some aspects of the present invention as set forth in the remainder of the present application with reference to the drawings.

BRIEF SUMMARY OF THE INVENTION

In accordance with an exemplary embodiment of the invention, a cosmetic apparatus comprising a self-adhesive cosmetic application guard and/or stencil is provided. In various exemplary embodiments of the invention, the self-adhesive cosmetic application guard and/or stencil may comprise an upper edge, a lower edge, an extended flap, a front surface and a rear surface. The upper edge is shaped according to a natural curvature of a human lower eyelid. A texture of one or both of the front surface and the rear surface enables the self-adhesive cosmetic application guard and/or stencil to self-adhere to a users' skin. The extended flap enables grasping of the self-adhesive cosmetic application guard and/or stencil so as to avoid contact with areas of cosmetic application during removal of the self-adhesive cosmetic application guard and/or stencil from the users face. The front surface and the rear surface of the self-adhesive cosmetic application guard and/or stencil may comprise silica material. The front surface and/or the rear surface of the self-adhesive cosmetic application guard and/or stencil is glossy so that the self-adhesive cosmetic application guard and/or stencil is operable to firmly adhere to the users' skin without use of any additional adhesive product or material. The texture of one or both of the front surface and the rear surface of the self-adhesive cosmetic application guard and/or stencil comprise a non-slip surface. The non-slip surface comprises a dull finish.

The self-adhesive cosmetic application guard and/or stencil comprise soft, flexible, durable and impenetrable material capable of contouring to the natural curvature of the human lower eyelid. The soft, flexible, durable and impenetrable material comprises Thermoplastic Elastomers (TPE), Liquid Silicone Rubbers (LSR), Polyvinyl chloride (PVC), and/or injection molded material. The self-adhesive cosmetic application guard and/or stencil comprise material that is impervious to liquids, glues, loose powder and/or makeup. The cosmetic application guard and/or stencil comprises material that is non-absorbent, when compared to paper and/or cotton, when the self-adhesive cosmetic application guard and/or stencil is in contact with liquids, gels and/or glues. The self-adhesive cosmetic application guard and/or stencil comprise material that is washable after cosmetic application and the self-adhesive cosmetic application guard and/or stencil maintains it original composition and consistency during and after washing. The self-adhesive cosmetic application guard and/or stencil comprise material that enables the self-adhesive cosmetic application guard and/or stencil to be reusable a plurality of times. The self-adhesive cosmetic application guard and/or stencil comprise material that is antibacterial, antiviral viral and/or dermatologically harmless.

In various embodiments of the invention, the self-adhesive cosmetic application guard and/or stencil comprises a consistent, even upper edge that functions as a stencil for drawing exact eyeliners. The self-adhesive cosmetic application guard and/or stencil comprises soft, flexible, durable and self-adhesive material, which enables the user to use place the cosmetic application guard and/or stencil below a lower eyelid where it functions as stencil for makeup eyeliner. The self-adhesive cosmetic application guard and/or stencil comprise a right portion and a left portion, which enables the user to perform cosmetic application on both eyes simultaneously. The self-adhesive cosmetic application guard and/or stencil covers an entire area just below the users' eyes and/or below the users' lower eye lashes including parts of the user's cheekbone.

Another embodiment of the invention provides a cosmetic apparatus for facial use. The cosmetic apparatus may comprise a self-adhesive pad comprising an upper edge, a lower edge, and a front surface and rear surface. A texture of one or both of the front surface and the rear surface of the self-adhesive pad enable the self-adhesive pad to self-adhere to a users' skin prior to and during application of a facial cosmetic. The upper edge of the self-adhesive pad is shaped according to a natural curvature of the user's lower eyelid and/or the users' lower eye lashes. The self-adhesive pad comprises an extended flap located along one or both of the upper edge and the lower edge. The extended flap is enables removal of the self-adhesive pad from the users' skin by grasping of the extended flap. The front surface and/or the rear surface of the self-adhesive pad comprise silica material. The self-adhesive pad comprises soft, flexible, durable and impenetrable material capable of contouring to the natural curvature of the human lower eyelid. The soft, flexible, durable and impenetrable material comprises Thermoplastic Elastomers (TPE), Liquid Silicone Rubbers (LSR), Polyvinyl chloride (PVC), and/or injection molded material. The front surface and/or the rear surface of the self-adhesive pad comprise a non-slip surface. The non-slip surface comprises a dull finish.

These and other advantages, aspects and novel features of the present invention, as well as details of an illustrated embodiment thereof, will be more fully understood from the following description and drawings.

DETAILED DESCRIPTION OF THE INVENTION

Figure 1:
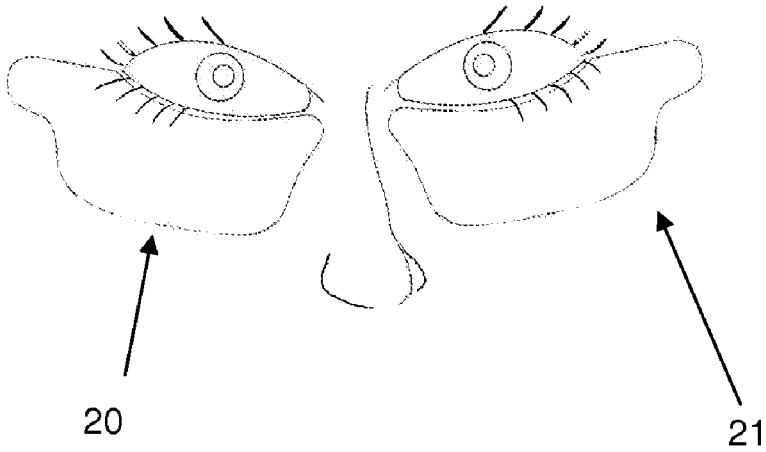
FIG. 1 is diagram illustrating an environmental, perspective view of an exemplary self-adhesive cosmetic application guard and/or stencil when it is placed under the users eyes, in accordance with an embodiment of the invention.

Certain embodiments of the invention may be found in a method and apparatus for a self-adhesive cosmetic application guard and/or stencil. In various exemplary embodiments of the invention, the self-adhesive cosmetic application guard and/or stencil may comprise an upper edge, a lower edge, an extended flap, a front surface and a rear surface. The upper edge is shaped according to a natural curvature of a human lower eyelid. A texture of one or both of the front surface and the rear surface enables the self-adhesive cosmetic application guard and/or stencil to self-adhere to a users' skin. The extended flap enables grasping of the self-adhesive cosmetic application guard and/or stencil so as to avoid contact with areas of cosmetic application during removal of the self-adhesive cosmetic application guard and/or stencil from the users face. The front surface and the rear surface of the self-adhesive cosmetic application guard and/or stencil may comprise silica material. The front surface and/or the rear surface of the self-adhesive cosmetic application guard and/or stencil is glossy so that the self-adhesive cosmetic application guard and/or stencil is operable to firmly adhere to the users' skin without use of any additional adhesive product or material. The texture of one or both of the front surface and the rear surface of the self-adhesive cosmetic application guard and/or stencil comprise a non-slip surface. The non-slip surface comprises a dull finish. In an exemplary embodiment of the invention, each self-adhesive cosmetic application guard and/or stencil may be about 97 mm long and 42 mm wide with a curvature that may be shaped according to the natural curvature of an average human lower eyelid. These dimensions of the self-adhesive cosmetic application guard and/or stencil are exemplary dimensions and the invention is not limited in this regard. Accordingly, other dimensions may be utilized without departing from the spirit and/or scope of the invention.

Another embodiment of the invention provides a cosmetic apparatus for facial use. The cosmetic apparatus may comprise a self-adhesive pad comprising an upper edge, a lower edge, and a front surface and rear surface. A texture of one or both of the front surface and the rear surface of the self-adhesive pad enable the self-adhesive pad to self-adhere to a users' skin prior to and during application of a facial cosmetic. The upper edge of the self-adhesive pad is shaped according to a natural curvature of the user's lower eyelid and/or the users' lower eye lashes. The self-adhesive pad comprises an extended flap located along one or both of the upper edge and the lower edge. The extended flap is enables removal of the self-adhesive pad from the users' skin by grasping of the extended flap. The front surface and/or the rear surface of the self-adhesive pad comprise silica material. The self-adhesive pad comprises soft, flexible, durable and impenetrable material capable of contouring to the natural curvature of the human lower eyelid. The soft, flexible, durable and impenetrable material comprises Thermoplastic Elastomers (TPE), Liquid Silicone Rubbers (LSR), Polyvinyl chloride (PVC), and/or injection molded material. The front surface and/or the rear surface of the self-adhesive pad comprise a non-slip surface. The non-slip surface comprises a dull finish. Other soft, flexible, durable and/or impenetrable material may be utilized without departing from the spirit and/or scope of the invention.

FIG. 1 is diagram illustrating an environmental, perspective view of an exemplary self-adhesive cosmetic application guard and/or stencil when it is placed under the users eyes, in accordance with an embodiment of the invention. Referring to FIG. 1, there is shown self-adhesive cosmetic application guards and/or stencils comprising a self-adhesive cosmetic application guard/stencil 21 for left eye application and a self-adhesive cosmetic application guard/stencil 20 for right eye application. One or both of the self-adhesive cosmetic application guard/stencil 21 for left eye application and/or the self-adhesive cosmetic application guard/stencil 20 for right eye application are placed under the corresponding users' eyes. The self-adhesive cosmetic application guard/stencil 21 for left eye application and/or the self-adhesive cosmetic application guard/stencil 20 for right eye application may be utilized during a variety of cosmetic applications to protect the skin area just below the eyes and/or the lower lashes including parts of the cheekbone from dyes, adhesives, and excess makeup.

Figure 2:
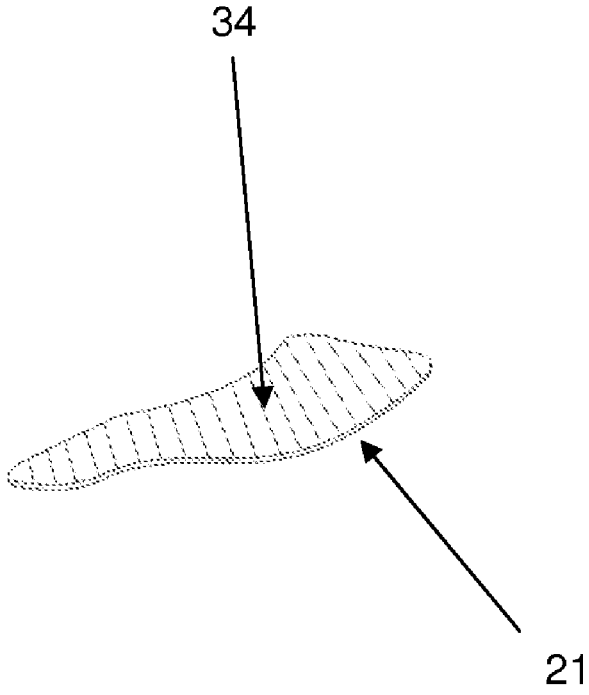
FIG. 2 is a perspective view of an exemplary self-adhesive cosmetic application guard and/or stencil, in accordance with an embodiment of the invention.

FIG. 2 is a perspective view of an exemplary self-adhesive cosmetic application guard and/or stencil, in accordance with an embodiment of the invention. Referring to FIG. 2, there is shown a self-adhesive cosmetic application guard/stencil 21.

With reference to FIG. 2, the self-adhesive cosmetic application guard/stencil 21 for left eye application and/or the self-adhesive cosmetic application guard/stencil 20 for right eye application may comprise a flexible body and a glossy front side 34 represented by the shaded areas able to adhere to the users' skin without using additional products.

Figure 3:
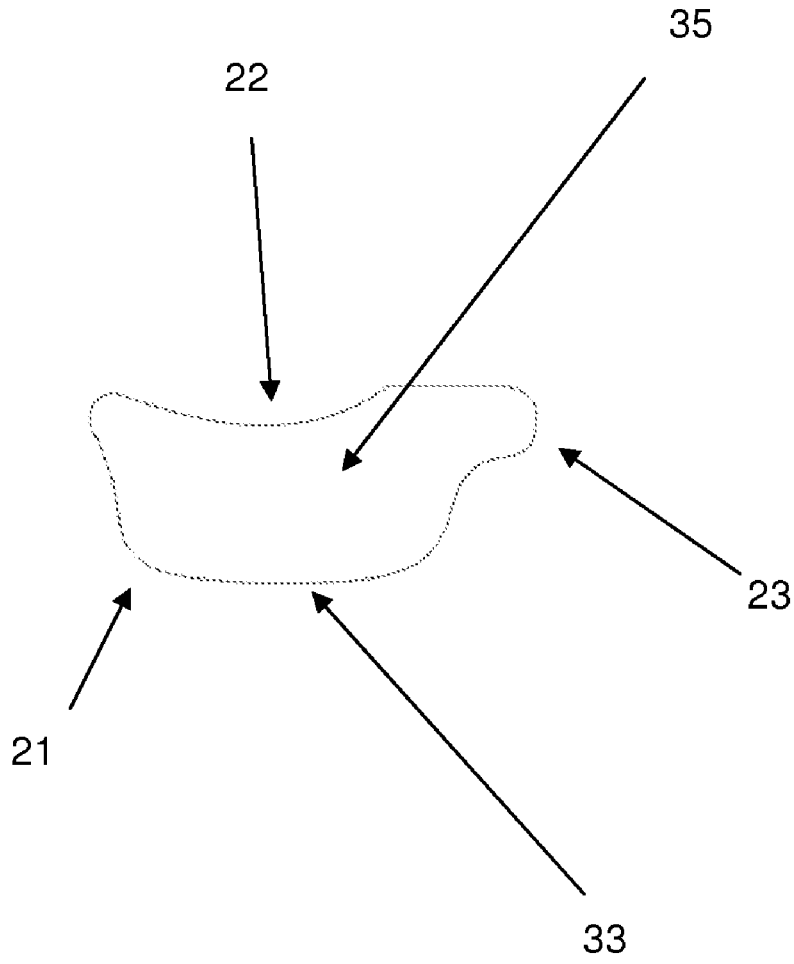
FIG. 3 is a rotated top view of the left part of an exemplary self-adhesive cosmetic application guard and/or stencil, showing the matt finish backside, in accordance with an embodiment of the invention.

FIG. 3 is a rotated top view of the left part of an exemplary self-adhesive cosmetic application guard and/or stencil 21, showing the matt finish backside 35, in accordance with an embodiment of the invention. Referring to FIG. 3, there is shown a self-adhesive cosmetic application guard/stencil 21 comprising an upper edge 22, a lower edge 33 and a flap 23. The upper edge 22 is curved or curvilinear and follows the general contour of the average human eye.

With reference to FIG. 3, the self-adhesive cosmetic application guard and/or stencil comprise a curvature that is shaped according to or conforms to the natural curvature of an average human lower eyelid. Extending to the left side from the users' perspective, there is as shown in a flap 23 that enables the user to detach the self-adhesive cosmetic application guard/stencil 21 after completing the desired cosmetic application. The upper edge 22 of the self-adhesive cosmetic application guard/stencil 21 and general flexibility of the entire body of the self-adhesive cosmetic application guard/stencil 21 enables the self-adhesive cosmetic application guard/stencil 21 to adapt to the various lower eyelid configurations or contours of different users.

Figure 4:
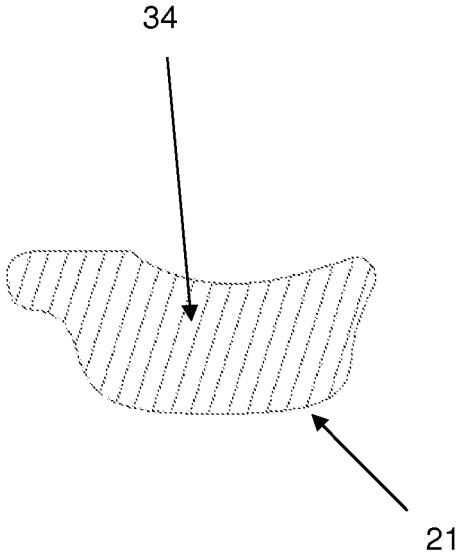
FIG. 4 is a top view of the left part of an exemplary self-adhesive cosmetic application guard and/or stencil, showing the self-adhesive glossy front side, in accordance with an embodiment of the invention.

FIG. 4 is a top view of the left part of an exemplary self-adhesive cosmetic application guard and/or stencil 21, showing the self-adhesive glossy front side 34, in accordance with an embodiment of the invention. Referring to FIG. 2, there is shown a self-adhesive cosmetic application guard/stencil 21.

With reference to FIG. 4, the self-adhesive cosmetic application guard/stencil 21 may comprise a flexible body and a glossy front side 34 represented by the shaded areas able to adhere to the users' skin without using additional products.

Figure 5:
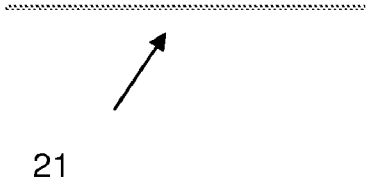
FIG. 5 is a front view of an exemplary self-adhesive cosmetic application guard and/or stencil, in accordance with an embodiment of the invention.

FIG. 5 is a front view of an exemplary self-adhesive cosmetic application guard and/or stencil, in accordance with an embodiment of the invention. Referring to FIG. 5, there is shown a narrow front view of the self-adhesive cosmetic application guard/stencil 21 which provides the desired flexibility while remaining impenetrable to dyes, adhesives and excess makeup.

The various embodiments illustrated with respect to FIGS. 6-12 illustrate the left side of the self-adhesive cosmetic application guard/stencil 21 in-use during the various cosmetic applications. As illustrated in FIG. 6-12, the self-adhesive glossy front side FIG. 4 of the self-adhesive cosmetic application guard/stencil 21 is placed onto the users' skin. The various cosmetic applications illustrated in FIG. 6-12 may be performed using both hands and in an upright position. Although the left side is shown for exemplary illustrative proposes, the invention is not limited in this regard. Accordingly, similar functions and/or applications apply to the right side or portion the self-adhesive cosmetic application guard/stencil 21.

Figure 6:
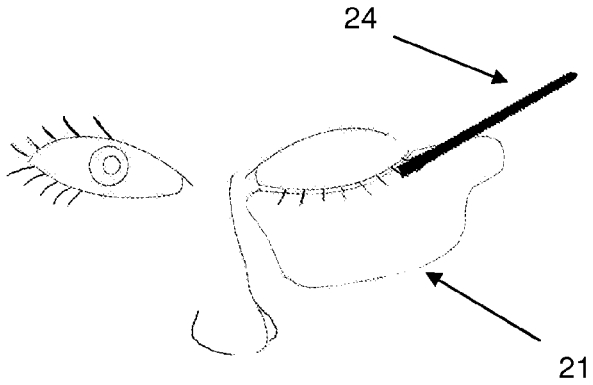
FIG. 6 is a perspective view illustrating a cosmetic application guard/stencil functioning during the application of eyelash dye, in accordance with an embodiment of the invention.

FIG. 6 is a perspective view illustrating a cosmetic application guard/stencil functioning during the application of eyelash dye, in accordance with an embodiment of the invention. Referring to FIG. 6, there is shown a narrow edge of the self-adhesive cosmetic application guard/stencil 21 and a dye applicator 24.

With regard to FIG. 6, the self-adhesive cosmetic application guard/stencil 21 is shown in-use during the cosmetic application of tinting upper and lower eyelashes. The upper edge 22, which is shown in FIG. 3, of the self-adhesive cosmetic application guard/stencil 21 is placed directly under the lower eyelash to protect the skin from dyes. The dye applicator 24 is then used to apply eyelash dye.

Generally, during eyelash tinting, the eyes are protected by disposable eye protection, such as eye protection papers or other non-adhesive, absorbent materials such as cotton to avoid unwanted dye to reach the skin. Since protection paper or cotton is non-adhesive it must be fixated with additional products such as cream. In order to achieve the best possible tinting results the eyelashes must be clean, free of oil and dry. However, during fixation of protection paper or cotton, creams may reach the eyelashes making it impossible to apply eyelash dye. Protection papers and cotton are absorbent in nature and therefore tend to waste dye that should be absorbed by the lashes.

The self-adhesive cosmetic application guard/stencil 21 may provide a washable, reusable cosmetic application apparatus that is operable to protect the skin area just below the eyes from eyelash dye during eyelash tinting. The self-adhesive cosmetic application guard/stencil 21 may also provide a cosmetic application apparatus that may be utilized for tinting eyelashes that self-adheres to the skin avoiding the use of creams and other dye repellent substances. The self-adhesive cosmetic application guard/stencil 21 may also provide a cosmetic application apparatus for dying eyelashes without the absorbing properties of paper or cotton, improving tinting results while applying less dye.

Figure 7:
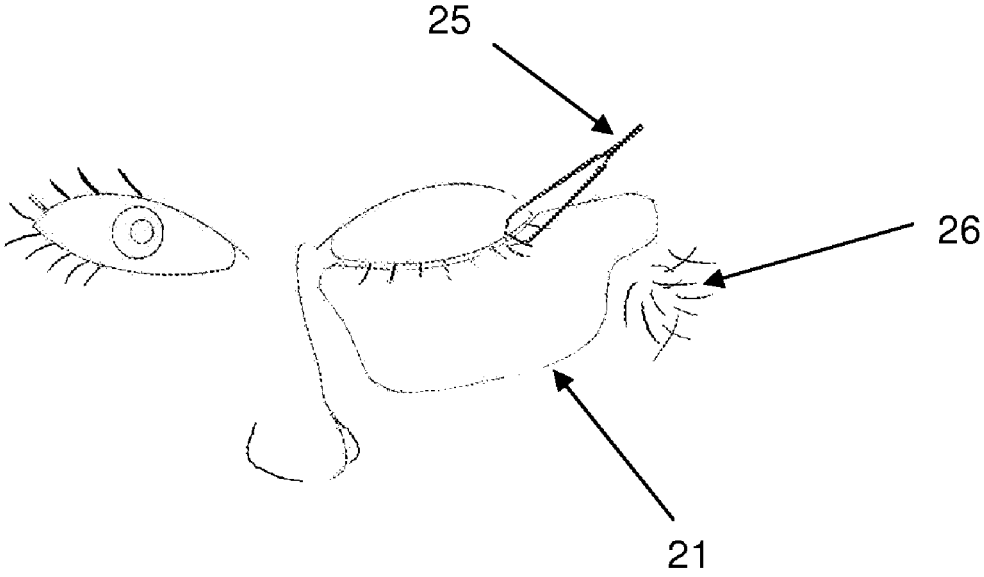
FIG. 7 is a perspective view illustrating a cosmetic application guard/stencil functioning during the application of individual false eyelashes, in accordance with an embodiment of the invention.

FIG. 7 is a perspective view illustrating a cosmetic application guard/stencil functioning during the application of individual false eyelashes, in accordance with an embodiment of the invention. Referring to FIG. 7, there is shown a self-adhesive cosmetic application guard/stencil 21, a false eyelash applicator 25, and individual false eyelashes 26.

With reference to FIG. 7, the self-adhesive cosmetic application guard/stencil 21 is shown in-use during the cosmetic application of applying single false eyelashes 26. The upper edge 22, which is shown in FIG. 3, of the self-adhesive cosmetic application guard/stencil 21 may be placed above the lower eyelash providing a barrier between the upper and lower eyelash. The false eyelash applicator 25 is then used to apply the individual false eyelashes 26 onto/in-between the upper eyelashes.

When applying one of the two types of false eyelashes or eyelash extensions, full eyelashes and individual eyelashes, the lower eyelashes are taped down using disposable plastic or paper tape to avoid eyelash adhesives of reaching the lower eyelashes and skin area just below the eyes. The self-adhesive cosmetic application guard/stencil 21 is operable to provide a cosmetic application apparatus to cover the lower eyelashes during application of false eyelashes 26 or eyelash extensions to protect the lower eyelashes and skin area just below the eyes from eyelash adhesives without having to tape down the lower eyelashes. The self-adhesive cosmetic application guard/stencil 21 may also provide a washable, reusable cosmetic application apparatus to cover the lower eyelashes during application of false eyelashes or eyelash extensions to protect the lower eyelashes and skin area just below the eyes from eyelash adhesives.

Figure 8:
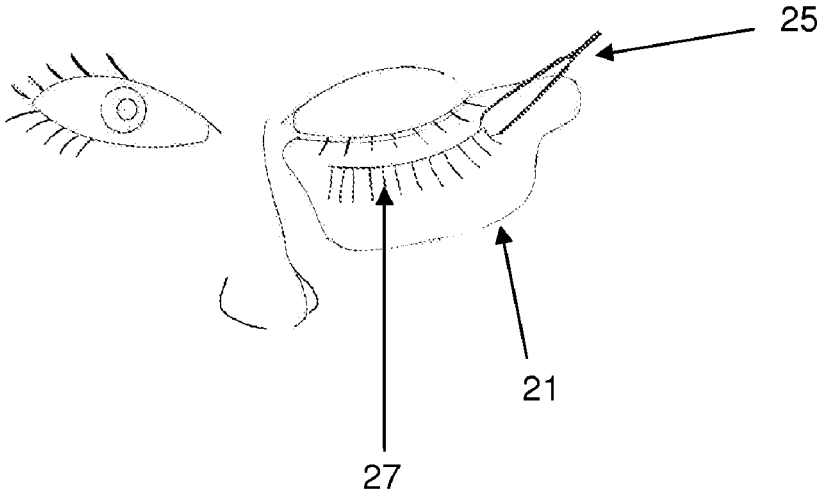
FIG. 8 is a diagram illustrating a perspective view illustrating a cosmetic application guard/stencil functioning during the application of full false eyelashes, in accordance with an embodiment of the invention.

FIG. 8 is a diagram illustrating a perspective view illustrating a cosmetic application guard/stencil functioning during the application of full false eyelashes, in accordance with an embodiment of the invention. Referring to FIG. 8, there is shown a self-adhesive cosmetic application guard/stencil 21, a false eyelash applicator 25, and full false eyelashes 27.

With reference to FIG. 8, the self-adhesive cosmetic application guard/stencil 21 is shown in-use during the cosmetic application of the full false eyelashes 27 by the false eyelash applicator 25. The narrow edge, which is shown in FIG. 2, of the self-adhesive cosmetic application guard/stencil 21, may be placed above the lower eyelash providing a barrier between the upper and lower eyelash. The false eyelash applicator 25 is then used to apply the full false eyelashes 27 onto the upper eyelashes.

When applying one of the two types of false eyelashes or eyelash extensions, full eyelashes and individual eyelashes, the lower eyelashes are taped down using disposable plastic or paper tape to avoid eyelash adhesives reaching the lower eyelashes and skin area just below the eyes. The self-adhesive cosmetic application guard/stencil 21 is operable to provide a cosmetic application apparatus to cover the lower eyelashes during application of false eyelashes 26 or eyelash extensions to protect the lower eyelashes and skin area just below the eyes from eyelash adhesives without having to tape down the lower eyelashes. The self-adhesive cosmetic application guard/stencil 21 may also provide a washable, reusable cosmetic application apparatus to cover the lower eyelashes during application of false eyelashes or eyelash extensions to protect the lower eyelashes and skin area just below the eyes from eyelash adhesives.

Figure 9:
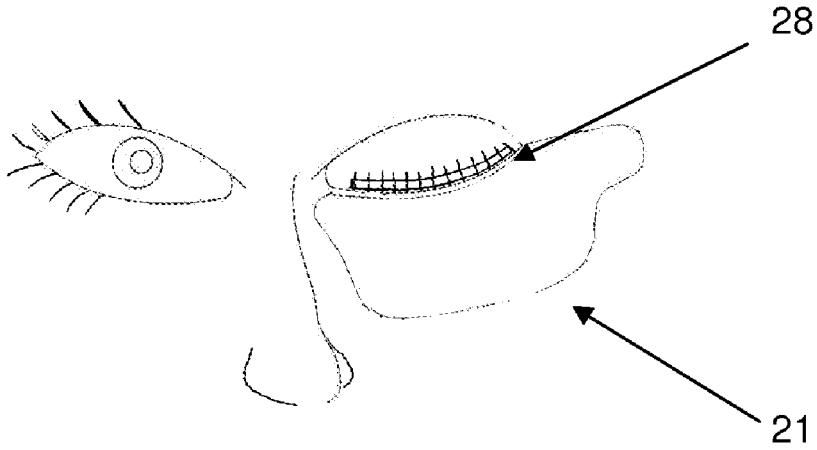
FIG. 9 is a diagram illustrating a perspective view of a cosmetic application guard/stencil functioning during the application of perming eyelashes, in accordance with an embodiment of the invention.

FIG. 9 is a diagram illustrating a perspective view of a cosmetic application guard/stencil functioning during the application of perming eyelashes, in accordance with an embodiment of the invention. Referring to FIG. 9, there is shown a self-adhesive cosmetic application guard/stencil 21 and an eyelash perm rod 28.

With reference to FIG. 9, the self-adhesive cosmetic application guard/stencil 21 is shown in-use during the cosmetic application of perming the upper eyelashes. The upper edge 22, which is shown in FIG. 3, of the self-adhesive cosmetic application guard/stencil 21, may be placed above the lower eyelash providing a barrier between the upper and lower eyelash. The upper eyelashes are fixated around an eyelash perm rod 28.

When perming eyelashes the upper eyelashes are fixated onto the eyelash perm rod 28 to achieve the desired perm. These eyelash perm rod(s) 28 are pre-treated with glue and additional glue is used to fully fixate the upper eyelashes onto the rod. To ensure that no lower eyelashes are curled around the eyelash perm rod 28, the lower eyelashes are either taped down using disposable plastic or paper tape and/or disposable eye protection such as cotton. The self-adhesive cosmetic application guard/stencil 21 is operable to provide a self-adhesive cosmetic apparatus to cover the lower eyelashes during application of eyelash perm rod(s) 28 without having to tape down the lower eyelashes. The self-adhesive cosmetic application guard/stencil 21 is operable to provide a washable, reusable cosmetic application apparatus to cover the lower eyelashes when perming the upper eyelashes to protect the lower eyelashes and skin area just below the eyes from glue and other adhesives.

Figure 10:
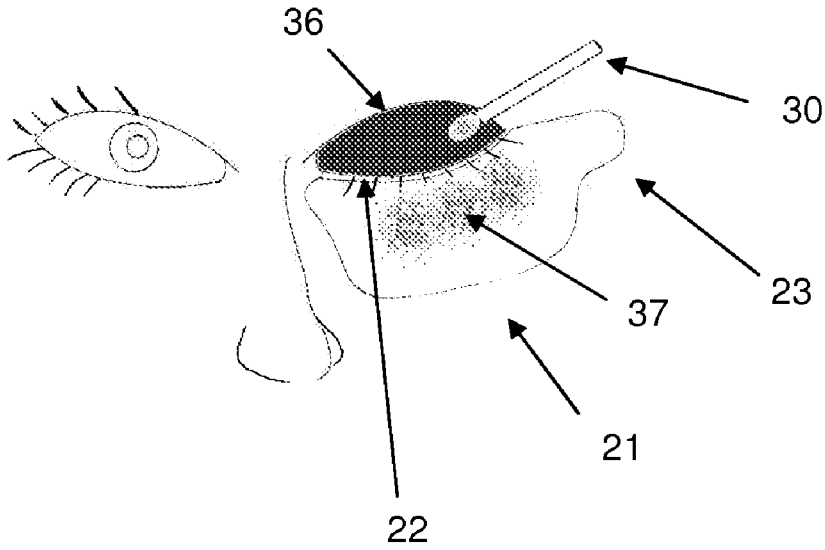
FIG. 10 is a diagram illustrating a perspective view of a cosmetic application guard/stencil functioning during the application of eyeshadow makeup to the upper eyelid in accordance with an embodiment of the invention.

FIG. 10 is a diagram illustrating a perspective view of a cosmetic application guard/stencil functioning during the application of eyeshadow makeup to the upper eyelid, in accordance with an embodiment of the invention. Referring to FIG. 10, there is shown a self-adhesive cosmetic application guard/stencil 21, upper edge 22 of the self-adhesive cosmetic application guard/stencil 21, and a flap 23.

Figure 13:
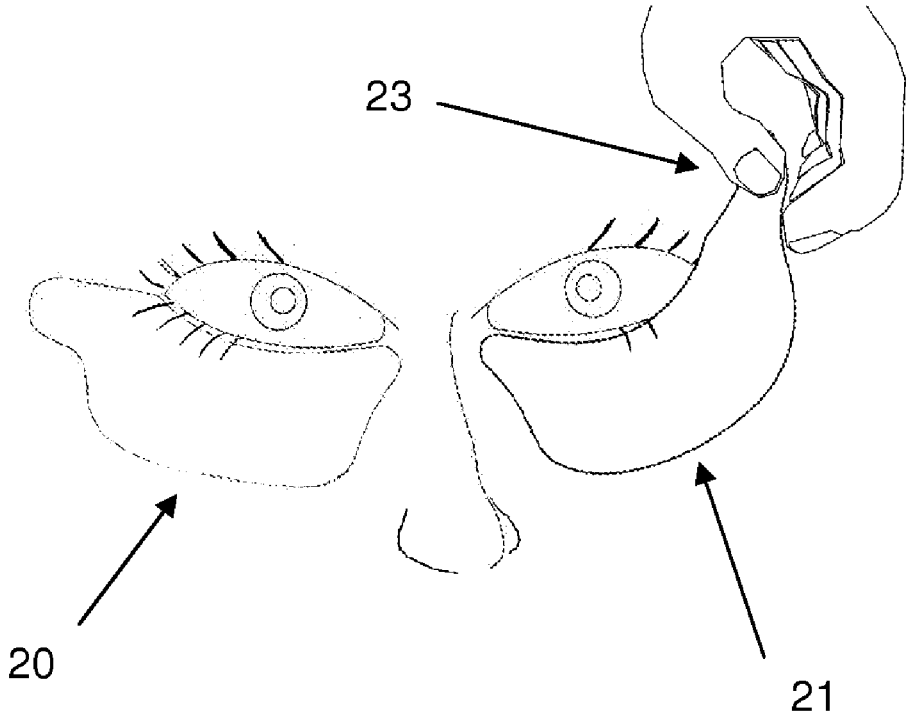
FIG. 13 is a diagram illustrating a guard/stencil when it is removed after cosmetic application, in accordance with an embodiment of the invention.

With reference to FIG. 10, the self-adhesive cosmetic application guard/stencil 21 is shown in-use during the cosmetic application of eyeshadow with an applicator 30 to the upper eyelid 36. The upper edge 22, which is shown in FIG. 3, of the self-adhesive cosmetic application guard/stencil 21 is placed below the lower eyelash providing a barrier between the applied makeup and the users' skin. The self-adhesive cosmetic application guard/stencil 21, which is also shown in FIG. 2 and FIG. 4, may comprise a flexible body and a glossy front side, represented by the shaded areas, which adheres to the users' skin even when it has been previously treated with makeup. The self-adhesive cosmetic application guard/stencil 21 functions in such a manner that it will not remove any previously applied makeup when removed from the skin by grasping the flap 23. The flap 23 is shown in FIG. 13. As seen in FIG. 10, excess eyeshadow 37 is collected on the matt finish backside of the apparatus (guard/stencil 21) illustrated in FIG. 3.

The application of makeup to areas surrounding the eye including eyelashes, the eyelids and the eyebrows may be a time consuming task that requires a steady hand so that the makeup is not smudged or smeared in with previously applied makeup. The makeup may also drip or fall of applicators onto the user's lower eyelid or upper areas of the cheekbone. Accordingly, in various embodiments of the invention, the self-adhesive cosmetic application guard/stencil 21 may be operable to provide support for makeup users during makeup application by preventing the smudging or smearing of makeup with previously applied makeup including makeup foundation. The self-adhesive cosmetic application guard/stencil 21 may be operable to prevent makeup from dripping or falling of applicators 30 or upper eyelids 36 onto the user's lower eyelid or upper areas of the cheekbone. The self-adhesive cosmetic application guard/stencil 21 may also be operable to provide a durable, reusable, washable, makeup guard/stencil 21 which self-adheres to skin that has previously been treated with make-up foundation. The self-adhesive cosmetic application guard/stencil 21 may support a user of the apparatus, for example by providing guidance, while applying makeup, for example, eyeliner to the lower eyelid using the self-adhesive cosmetic application guard/stencil 21 as stencil for drawing exact eyeliner. The self-adhesive cosmetic application guard/stencil 21 is operable to provide an apparatus, which when removed from the skin, will not remove any previously applied makeup and/or makeup foundation.

Figure 11:
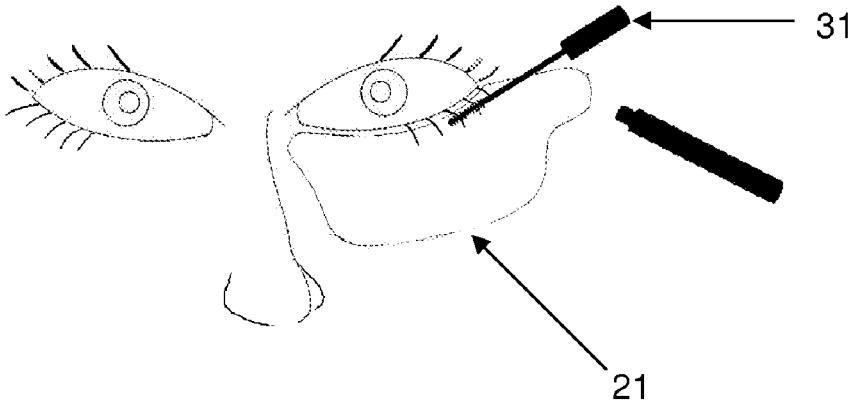
FIG. 11 is a diagram illustrating a perspective view of a cosmetic application guard/stencil functioning during the application of mascara, in accordance with an embodiment of the invention.

FIG. 11 is a diagram illustrating a perspective view of a cosmetic application guard/stencil functioning during the application of mascara, in accordance with an embodiment of the invention. Referring to FIG. 11, there is shown a self-adhesive cosmetic application guard/stencil 21.

With reference to FIG. 11, the self-adhesive cosmetic application guard/stencil 21 is shown in-use with an applicator 31 during the cosmetic application of mascara to the lower eyelashes. The upper edge 22, which is shown in FIG. 3, of the self-adhesive cosmetic application guard/stencil 21, is placed below the lower eyelash providing a barrier between the applied makeup and the users' skin. The self-adhesive cosmetic application guard/stencil 21 comprises a flexible body and a glossy front side represented by the shaded areas, are operable adhere to the users' skin even when it has been previously treated with makeup. The self-adhesive cosmetic application guard/stencil 21 functions so as not to remove any previously applied makeup when removed from the skin. The self-adhesive cosmetic application guard/stencil 21 may be removed from the skin by grasping the flap 23, which is shown in FIG. 13.

Figure 12:
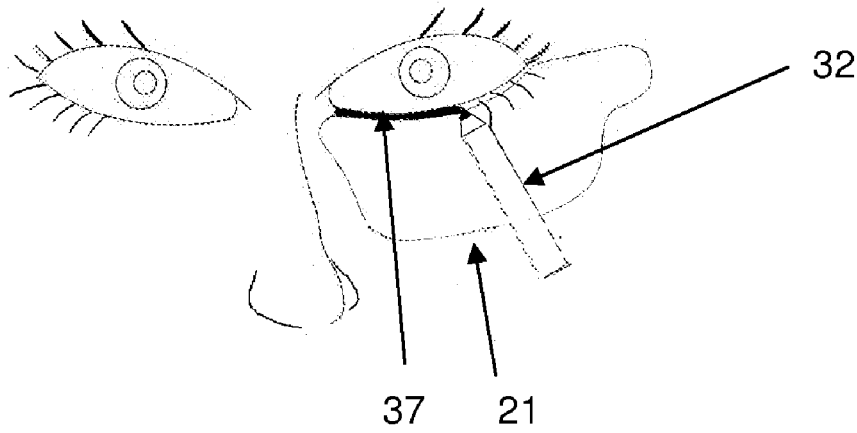
FIG. 12 is a diagram illustrating a perspective view of a cosmetic application guard/stencil functioning as stencil for exact eyeliner, in accordance with an embodiment of the invention.

FIG. 12 is a diagram illustrating a perspective view of a cosmetic application guard/stencil functioning as a stencil for exact eyeliner, in accordance with an embodiment of the invention. Referring to FIG. 12, there is shown a self-adhesive cosmetic application guard/stencil 21.

With reference to FIG. 12, the self-adhesive cosmetic application guard/stencil 21 is shown in-use during the cosmetic application of applying eyeliner 32 to the lower eyelid. The upper edge 22, which is shown in FIG. 3, of the self-adhesive cosmetic application guard/stencil 21 is placed below the lower eyelash according to the desired width of the eyeliner 32 providing a stencil to draw an accurate eye line 37.

FIG. 13 is a diagram illustrating a guard/stencil when it is removed after cosmetic application, in accordance with an embodiment of the invention. Referring to FIG. 13, there is shown a self-adhesive cosmetic application guard/stencil 21 comprising a flap 23.

With reference to FIG. 13, removal of the self-adhesive cosmetic application guard/stencil 21 after cosmetic application is shown. In accordance with an embodiment of the invention, the self-adhesive cosmetic application guard/stencil 21 may be appropriately removed by grasping its flap 23 after completing the desired cosmetic application. This enables the user or person that applied the cosmetic to detach the self-adhesive cosmetic application guard/stencil 21, which now may be stained by dyes, adhesives or excess makeup, without causing contact that would ruin the applied cosmetic.

In accordance with various embodiments of the invention, the self-adhesive cosmetic application guard/stencil 21 may comprise two separate pads, namely, one for the right side of the face and one for left side of the face. In an exemplary embodiment of the invention, each self-adhesive cosmetic application guard/stencil 21 may be about 97 mm long and 42 mm wide with a top curvature that is shaped according to the natural curvature of an average human lower eyelid. It should be readily understood that the size of the the self-adhesive cosmetic application guard/stencil 21 may vary without departing from the various aspects and scope of the invention. For example, the dimensions of length, width and/or thickness of the may be increased and/or decreased without departing from the spirit and/or scope of the invention. Other soft, flexible, durable and/or impenetrable material may be utilized without departing from the spirit and/or scope of the invention. Notwithstanding, the flexibility of self-adhesive cosmetic application guard/stencil 21 allows the self-adhesive cosmetic application guard/stencil 21 to fit the different sizes of eyes found in human beings. The self-adhesive cosmetic application guard/stencil 21 for left eye application and the self-adhesive cosmetic application guard/stencil 20 for right eye application may be used simultaneously or one after the other by lightly pressing it against the skin area just below the eye. The size and width of the pad result from the best possible protection for the skin area just below the eyes including parts of the cheekbone. The self-adhesive cosmetic application guard/stencil 21 is manufactured using injection molding techniques that are characteristic for exemplary materials comprising Thermoplastic Elastomers (TPE), Liquid Silicone Rubbers (LSR), and Polyvinyl chloride (PVC). This provides that the self-adhesive cosmetic application guard/stencil 21 is free of sharp edges, flexible, durable and impenetrable to artificial colors, glues and makeup. Furthermore, the material may be easily cleaned and contains no materials that may cause damage to the human eyes or surrounding skin.

In various embodiments of the invention, the self-adhesive cosmetic application guard/stencil 21 may comprise a glossy inner surface capable of firmly adhering to the human skin without using additional products. The outer of surface the self-adhesive cosmetic application guard/stencil 21 may comprise a matt finish. The self-adhesive cosmetic application guard/stencil 21 may support a variety of cosmetic applications such as tinting eyelashes, false eyelash application, individual false eyelash application, and applying various types of makeup around the eyes, eyelashes, eyelids and eyebrows. Depending on the type of cosmetic application that is performed, the self-adhesive cosmetic application guard/stencil 21 may be placed just underneath the eye to cover the lower eyelashes or just below the lower eyelashes. After correct application of the self-adhesive cosmetic application guard/stencil 21 any of the above mentioned cosmetic application can be performed. Due to the adhesive properties of the pad the user can perform the cosmetic application in an upright position. The guard prevents artificial colors, glues or makeup from being deposited on the skin and/or eyelashes underneath the guard. In instances when the self-adhesive cosmetic application guard/stencil 21 is positioned underneath the lower eyelash according to the desired width of the kohl eyeliner the pad acts as stencil for smudge free and symmetric kohl eye lines.

In accordance with an embodiment of the invention, a cosmetic apparatus comprising a self-adhesive cosmetic application guard and/or stencil 20 or 21. In various exemplary embodiments of the invention, the self-adhesive cosmetic application guard and/or stencil 20 or 21 may comprise an upper edge 22 of FIG. 3, a lower edge 33, an extended flap 23, a front surface 34 and a rear surface 35. The upper edge 22 is shaped according to a natural curvature of a human lower eyelid. A texture of one or both of the front surface 34 and the rear surface 35 enables the self-adhesive cosmetic application guard and/or stencil 20 or 21 to self-adhere to a users' skin. The extended flap 23 enables grasping of the self-adhesive cosmetic application guard and/or stencil 20 or 21 so as to avoid contact with areas of cosmetic application during removal of the self-adhesive cosmetic application guard and/or stencil 20 or 21 from the users face. The front surface and the rear surface of the self-adhesive cosmetic application guard and/or stencil 20 or 21 may comprise silica material. The front surface 34 and/or the rear surface 35 of the self-adhesive cosmetic application guard and/or stencil 20 or 21 is glossy so that the self-adhesive cosmetic application guard and/or stencil 20 or 21 is operable to firmly adhere to the users' skin without use of any additional adhesive product or material. The texture of one or both of the front surface 34 and the rear surface 35 of the self-adhesive cosmetic application guard and/or stencil comprise a non-slip surface. The non-slip surface comprises a dull finish.

The self-adhesive cosmetic application guard and/or stencil 20 or 21 comprise soft, flexible, durable and impenetrable material capable of contouring to the natural curvature of the human lower eyelid. The soft, flexible, durable and impenetrable material comprises Thermoplastic Elastomers (TPE), Liquid Silicone Rubbers (LSR), Polyvinyl chloride (PVC), and/or injection molded material. The self-adhesive cosmetic application guard and/or stencil 20 or 21 comprise material that is impervious to liquids, glues, loose powder and/or makeup. The cosmetic application guard and/or stencil comprises material that is non-absorbent, when compared to paper and/or cotton, when the self-adhesive cosmetic application guard and/or stencil 20 or 21 is in contact with liquids, gels and/or glues. The self-adhesive cosmetic application guard and/or stencil 20 or 21 comprise material that is washable after cosmetic application and the self-adhesive cosmetic application guard and/or stencil 20 or 21 maintains it original composition and consistency during and after washing. The self-adhesive cosmetic application guard and/or stencil 20 or 21 comprise material that enables the self-adhesive cosmetic application guard and/or stencil to be reusable a plurality of times. The self-adhesive cosmetic application guard and/or stencil 20 or 21 comprise material that is antibacterial, anti-viral viral and/or dermatologically harmless.

The self-adhesive cosmetic application guard and/or stencil 20 or 21 may also be utilized during facial chemical peels, which provide improved skin tone and firmness. During a facial chemical peel, the upper layers of the epidermis of the face are removed utilizing a superficial, a meduim depth or a deep peeling process. The chemical peeling process increased increase in collagen and elastin fiber-synthesis, thereby enabling the skin to renew itself so as to provide improved radiance. In this regard, lines, wrinkles and/or pigmentation spots may be reduced and a more smother complexion is provided. The self-adhesive cosmetic application guard and/or stencil 20 or 21 may be applied to the face during a facial peeling process so as to protect the area surrounding that which is being chemically peeled. In this manner, the self-adhesive cosmetic application guard and/or stencil 20 or 21 may act as a border around the area which is being chemically peeled.

In various embodiments of the invention, the self-adhesive cosmetic application guard and/or stencil 20 or 21 comprises a consistent, even upper edge that functions as a stencil for drawing exact eyeliners. The self-adhesive cosmetic application guard and/or stencil 20 or 21 comprises soft, flexible, durable and self-adhesive material, which enables the user to use place the cosmetic application guard and/or stencil 20 or 21 below a lower eyelid where it functions as stencil for makeup eyeliner. The self-adhesive cosmetic application guard and/or stencil comprise a right portion 20 and a left portion 21, which enables the user to perform cosmetic application on both eyes simultaneously or on each eye separately. The self-adhesive cosmetic application guard and/or stencil 20 or 21 covers an entire area just below the users' eyes and/or below the users' lower eye lashes including parts of the user's cheekbone.

Another embodiment of the invention provides a cosmetic apparatus for facial use. The cosmetic apparatus may comprise a self-adhesive pad 20 or 21 comprising an upper edge 22, a lower edge 33, and a front surface 34 and rear surface 35. The self-adhesive cosmetic application guard/stencil 21 and the self-adhesive cosmetic application guard/stencil 20 may also be referred to as self-adhesive pad 21 and 22, respectively. Notwithstanding, a texture of one or both of the front surface 34 and the rear surface 35 of the self-adhesive pad enable the self-adhesive pad 20 or 21 to self-adhere to a users' skin prior to and during application of a facial cosmetic. The upper edge 22 of the self-adhesive pad 20 or 21 is shaped according to a natural curvature of the user's lower eyelid and/or the users' lower eye lashes. The self-adhesive pad 20 or 21 comprises an extended flap 23 located along one or both of the upper edge 22 and the lower edge 33. The extended flap 23 is enables removal of the self-adhesive pad 20 or 21 from the users' skin by grasping of the extended flap 23. The front surface and/or the rear surface of the self-adhesive pad 20 or 21 comprise silica material. The self-adhesive pad 20 or 21 comprises soft, flexible, durable and impenetrable material capable of contouring to the natural curvature of the human lower eyelid. The soft, flexible, durable and impenetrable material comprises Thermoplastic Elastomers (TPE), Liquid Silicone Rubbers (LSR), Polyvinyl chloride (PVC), and/or injection molded material. The front surface 34 and/or the rear surface 35 of the self-adhesive pad 20 or 21 comprise a non-slip surface. In an exemplary embodiment of the invention, the non-slip surface comprises a dull finish.

In another embodiment of the invention, a method for application of cosmetic is provided, which comprise applying a self-adhesive cosmetic application guard and/or stencil 20 or 21 to a first portion of a face. The first portion of the face refers to a portion or area of the face where the self-adhesive cosmetic application guard and/or stencil 20 or 21 is applied. The self-adhesive cosmetic application guard and/or stencil 20 or 21 comprise an upper edge 22, a lower edge 33, an extended flap 23, a front surface 34 and a rear surface 35. The upper edge 22 is shaped according to a natural curvature of a human lower eyelid. A texture of the front surface 34 and/or the rear surface 35 enables the self-adhesive cosmetic application guard and/or stencil 20 or 21 to self-adhere to a users' skin. The extended flap 23 enables grasping of the self-adhesive cosmetic application guard and/or stencil 20 or 21 so as to avoid contact with areas of cosmetic application during removal of the self-adhesive cosmetic application guard and/or stencil 20 or 21. Facial cosmetic may then be applied to a second portion of the face. The second portion of the face refers to a portion of the face where the facial cosmetic is being applied. In this regard, the first portion of the face, over which the self-adhesive cosmetic application guard and/or stencil 20 or 21 is being applied, borders the second portion of the face where the facial cosmetic is being applied. Upon completion of the application of the facial or whenever it is otherwise necessary to remove the self-adhesive cosmetic application guard and/or stencil 20 or 21, the extended flap 23 may be grasped and then pulled or peeled away to remove the self-adhesive cosmetic application guard and/or stencil 20 or 21 from the first portion of the face. The front surface 34 and/or the rear surface 35 of the self-adhesive cosmetic application guard and/or stencil 20 or 21 comprises silica material. The front surface 34 and/or the rear surface 35 of the self-adhesive cosmetic application guard and/or stencil 20 or 21, which is glossy, may be applied to the first portion of the face so that the self-adhesive cosmetic application guard and/or stencil 20 or 21 firmly adheres to the users' skin without use of any additional adhesive product or material.

In another embodiment of the invention, a method for application of cosmetic is provided, which comprise applying a self-adhesive pad 20 or 21 to a first portion of a face. The first portion of the face refers to a portion or area of the face where the self-adhesive cosmetic application guard and/or stencil 20 or 21 is applied. The self-adhesive pad 20 or 21 comprises an upper edge 22, a lower edge 33, and a front surface 34 and rear surface 35. A texture of the front surface 34 and/or the rear surface 35 of the self-adhesive pad enables the self-adhesive pad 20 or 21 to self-adhere to a users' skin on the first portion of the face prior to and during application of a facial cosmetic. The upper edge 22 is shaped according to a natural curvature of the user's lower eyelid and/or the users' lower eye lashes. The facial cosmetic is then applied to a second portion of the face. The second portion of the face refers to a portion of the face where the facial cosmetic is being applied. In this regard, the first portion of the face, over which the self-adhesive cosmetic application guard and/or stencil 20 or 21 is being applied, borders the second portion of the face where the facial cosmetic is being applied. Upon completion of the application of the facial cosmetic, the self-adhesive pad 20 or 21 is then removed from the first portion of the face to which it is applied. An extended flap 23, which is located along one or both of the upper edge 22 and the lower edge 33 of the self-adhesive pad, is grasped so as to remove the self-adhesive pad 20 or 21 from the first portion of the user's face.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A cosmetic apparatus, the cosmetic apparatus comprising:

a self-adhesive cosmetic application guard and/or stencil comprising:

an upper edge, a lower edge, two side edges that connect the upper and lower edges, an extended flap, a front surface and a rear surface, wherein:

said upper edge is shaped according to a natural curvature of a human lower eyelid;

a texture of one or both of said front surface and said rear surface that enables said self-adhesive cosmetic application guard and/or stencil to self-adhere to a users' skin; and said extended flap extends longitudinally outwardly from the top edge beyond one of said two side edges and enables grasping of said self-adhesive cosmetic application guard and/or stencil so as to avoid contact with areas of cosmetic application during removal of said self-adhesive cosmetic application guard and/or stencil; wherein the self adhesive cosmetic application guard and/or stencil forms a width between the upper and lower edges and said extended flap has a width smaller than the width of the self-adhesive cosmetic application guard and/or stencil.

2. The cosmetic apparatus according to claim 1, wherein said front surface and said rear surface of said self-adhesive cosmetic application guard and/or stencil comprises silica material.

3. The cosmetic apparatus according to claim 1, wherein said self-adhesive cosmetic application guard and/or stencil comprises soft, flexible, durable and impenetrable material capable of contouring to said natural curvature of said human lower eyelid.

4. The cosmetic apparatus according to claim 3, wherein said soft, flexible, durable and impenetrable material comprises Thermoplastic Elastomers (TPE), Liquid Silicone Rubbers (LSR), Polyvinyl chloride (PVC), and injection molded material.

5. The cosmetic apparatus according to claim 1, wherein said self-adhesive cosmetic application guard and/or stencil comprises material that is impervious to liquids, glues, loose powder and/or makeup.

6. The cosmetic apparatus according to claim 1, wherein said cosmetic application guard and/or stencil comprises material that is non-absorbent, when said self-adhesive cosmetic application guard and/or stencil is in contact with liquids, gels and/or glues.

7. The cosmetic apparatus according to claim 1, wherein said self-adhesive cosmetic application guard and/or stencil comprises material that is washable after cosmetic application and said self-adhesive cosmetic application guard and/or stencil maintains its shape after said washing.

8. The cosmetic apparatus according to claim 1, wherein said self-adhesive cosmetic application guard and/or stencil comprises material that enables said self-adhesive cosmetic application guard and/or stencil to be reusable a plurality of times.

9. The cosmetic apparatus according to claim 1, wherein said self-adhesive cosmetic application guard and/or stencil comprises material that is antibacterial and/or antiviral.

10. The cosmetic apparatus according to claim 1, wherein said self-adhesive cosmetic application guard and/or stencil comprises material that is dermatologically harmless.

11. The cosmetic apparatus according to claim 1, wherein said self-adhesive cosmetic application guard and/or stencil comprises a consistent, even upper edge that functions as a stencil for drawing exact eyeliners.

12. The cosmetic apparatus according to claim 1, wherein said self-adhesive cosmetic application guard and/or stencil comprises soft, flexible, durable and self-adhesive material, which enables said user to use place said cosmetic application guard and/or stencil below a lower eyelid where it functions as stencil for makeup eyeliner.

13. The cosmetic apparatus according to claim 1, comprising at least twp of the self-adhesive cosmetic application guards and/or stencils to form a set, which enables said user to perform cosmetic application on both eyes simultaneously.

14. The cosmetic apparatus according to claim 1, wherein said self-adhesive cosmetic application guard and/or stencil covers an entire area just below said users' eyes and/or below said users' lower eye lashes including parts of said user's cheekbone.

15. The cosmetic apparatus according to claim 1, comprising a non-slip surface having a dull finish.

16. A method for application of cosmetic, the method comprising:

applying a self-adhesive cosmetic application guard and/or stencil to a first portion of a face, said self-adhesive cosmetic application guard and/or stencil comprising:

an upper edge, a lower edge, two side edges that connect the upper and lower edges, an extended flap, a front surface and a rear surface, wherein:

said upper edge is shaped according to a natural curvature of a human lower eyelid;

a texture of one or both of said front surface and said rear surface that enables said self-adhesive cosmetic application guard and/or stencil to self-adhere to a users' skin; and said extended flap extends longitudinally outwardly from the top edge beyond one of said two side edges and enables grasping of said self-adhesive cosmetic application guard and/or stencil so as to avoid contact with areas of cosmetic application during removal of said self-adhesive cosmetic application guard and/or stencil; wherein the self adhesive cosmetic application guard and/or stencil forms a width between the upper and lower edges and said extended flap has a width smaller than the width of the self-adhesive cosmetic application guard and/or stencil;

applying facial cosmetic to a second portion of said face; and grasping said extended flap to remove said self-adhesive cosmetic application guard and/or stencil from said first portion of said face.

17. The method according to claim 16, wherein said front surface and said rear surface of said self-adhesive cosmetic application guard and/or stencil comprises silica material.

18. The method according to claim 16, wherein said self-adhesive cosmetic application guard and/or stencil comprises soft, flexible, durable and impenetrable material capable of contouring to said natural curvature of said human lower eyelid.

19. The method according to claim 18, wherein said soft, flexible, durable and impenetrable material comprises Thermoplastic Elastomers (TPE), Liquid Silicone Rubbers (LSR), Polyvinyl chloride (PVC), and injection molded material.

20. The method according to claim 16, wherein said self-adhesive cosmetic application guard and/or stencil comprises material that is impervious to liquids, glues, loose powder and/or makeup.

21. The method according to claim 16, wherein said cosmetic application guard and/or stencil comprises material that is non-absorbent, when said self-adhesive cosmetic application guard and/or stencil is in contact with liquids, gels and/or glues.

22. The method according to claim 16, wherein said self-adhesive cosmetic application guard and/or stencil comprises material that is washable after cosmetic application and said self-adhesive cosmetic application guard and/or stencil maintains its original composition and consistency after said washing.

23. The method according to claim 16, wherein said self-adhesive cosmetic application guard and/or stencil comprises material that enables said self-adhesive cosmetic application guard and/or stencil to be reusable a plurality of times.

24. The method according to claim 16, wherein said self-adhesive cosmetic application guard and/or stencil comprises material that is antibacterial and/or antiviral.

25. The method according to claim 16, wherein said self-adhesive cosmetic application guard and/or stencil comprises material that is dermatologically harmless.

26. The method according to claim 16, wherein said self-adhesive cosmetic application guard and/or stencil comprises a consistent, even upper edge that functions as a stencil for drawing exact eyeliners.

27. The method according to claim 16, wherein said self-adhesive cosmetic application guard and/or stencil comprises soft, flexible, durable and self-adhesive material, which enables said user to use place said cosmetic application guard and/or stencil below a lower eyelid where it functions as stencil for makeup eyeliner.

28. The method according to claim 16, comprising at least twp of the self-adhesive cosmetic application guards and/or stencils to form a set, which enables said user to perform cosmetic application on both eyes simultaneously.

29. The method according to claim 16, wherein said self-adhesive cosmetic application guard and/or stencil covers an entire area just below said users' eyes and/or below said users' lower eye lashes including parts of said user's cheekbone.

* * * * *